United States Patent [19]

Costa

[11] Patent Number: 4,941,852

[45] Date of Patent: Jul. 17, 1990

[54] TERMINAL FOR BALLAST BOBBIN

[75] Inventor: Larry J. Costa, Danville, Ill.

[73] Assignee: Valmont Industries, Inc., Valley, Nebr.

[21] Appl. No.: 315,492

[22] Filed: Feb. 27, 1989

[51] Int. Cl.[5] ..... H01R 13/40

[52] U.S. Cl. ..... 439/733; 439/751

[58] Field of Search ..... 439/733, 751

[56] References Cited

U.S. PATENT DOCUMENTS 2,966,651 12/1960 Von Holtz ..... 439/733 X

*Primary Examiner*—Eugene F. Desmond

*Attorney, Agent, or Firm*—Zarley, McKee, Thomte, Voorhees & Sease

[57] ABSTRACT

A ballast bobbin terminal includes a substantially flat and resilient terminal member having a forward portion for insertion into a bobbin pocket, and a rearward portion which will project rearwardly from the bobbin pocket. The forward portion of the terminal has a notch in each side edge thereof, and a tooth bent downwardly along each side edge forwardly of the notches, with the forward edge of the notch forming the leading edge of the projecting tooth. Each tooth projects downwardly and rearwardly such that the terminal may be inserted forwardly into a bobbin pocket, the leading edge of each tooth being biased against a wall of the pocket and gripping the pocket wall to prevent rearward movement of the terminal. A method of forming a tooth in a terminal includes the initial step of punching a notch in each side edge of the terminal such that a notch is formed with a forward edge parallel to the forward end of the terminal. Preferably, the notch is formed by punching downwardly through the upper face of the terminal. A tooth is then formed in each edge of the terminal edges forwardly of the notches, by deflecting a portion of the terminal downwardly to form a tooth having a lower leading edge formed of the forward edge of the notch.

2 Claims, 2 Drawing Sheets

TERMINAL FOR BALLAST BOBBIN

TECHNICAL FIELD

The present invention relates generally to electrical terminals utilized on a fluorescent lamp ballast bobbin, and more particularly to an improved terminal with teeth for gripping the thermoplastic material of the bobbin.

BACKGROUND OF THE INVENTION

Plastic bobbins are utilized in ballasts for fluorescent lights and the like. One form of such a ballast is disclosed in U.S. patent application Ser. No. 257,538 filed Oct. 14, 1988, entitled "An Improved Ballast", the disclosure of which is incorporated herein by reference. The ballast of the co-pending application is formed of plastic and is molded through the use of one or more die parts having suitable cavities formed therein so that a bobbin is created including an elongated rectangular body member having a plurality of flanges and standoffs extending radially outwardly therefrom.

At at least one end of the bobbin, a series of flat metal terminals are mounted in receiving pockets formed in the bobbin. The terminals have tabs protruding therefrom upon which terminations from the coils are wound and joined by conductors to various other electrical connections. In order to retain the terminals in the receiving pockets of the bobbin, the edges of the terminal have a series of angular teeth punched therein which grip the plastic sides of the pocket to allow insertion of the terminal and retain the terminal in position.

The major problem with the terminals conventionally used, is in the gripping power of the teeth punched into the edges of the terminal. The transverse "leading" edge of the punched angular tooth is the gripping portion of the tooth, and contacts a wall of the bobbin pocket to prevent longitudinal movement of the terminal outwardly from the pocket. Because the teeth were conventionally formed of small tabs punched directly along the edges of the terminal, it was found that the "leading" edge would be formed slightly rounded by this punching action.

A rounded leading edge on the gripping tooth causes several problems. One problem is that the retention power of the tooth is greatly reduced because there is no sharp edge to grip the plastic side wall. A second problem is related to the first in that the reduction of retention power of the tooth requires the tooth to be bent at a more severe angle to increase the gripping power. A more severe angle increases the distortion of the bobbin pocket and increases the amount of force required to insert the terminal in the pocket. Both of these characteristics are clearly undesirable.

It is therefore a general object of the present invention to provide an improved terminal for a bobbin.

Another object of the present invention is to provide a terminal having teeth with a sharp leading edge for greater gripping power.

A further object of the present invention is to provide an improved terminal with increased gripping power but decreased insertion force and no distortion of the bobbin pocket, as compared to prior terminals.

Still another object of the present invention is to provide a method for forming teeth in a terminal which will produce a sharp leading edge on the tooth.

These and other objects of the present invention will be apparent to those skilled in the art.

SUMMARY OF THE INVENTION

The ballast bobbin terminal of the present invention includes a substantially flat and resilient terminal member having a forward portion for insertion into a bobbin pocket, and a rearward portion which will project rearwardly from the bobbin pocket. The forward portion of the terminal has a notch in each side edge thereof, and a tooth bent downwardly along each side edge forwardly of the notches, with the forward edge of the notch forming the leading edge of the projecting tooth. Each tooth projects downwardly and rearwardly such that the terminal may be inserted forwardly into a bobbin pocket, the leading edge of each tooth being biased against a wall of the pocket and gripping the pocket wall to prevent rearward movement of the terminal.

The method of forming a tooth in the terminal of the present invention includes the initial step of punching a notch in each side edge of the terminal such that a notch is formed with a forward edge parallel to the forward end of the terminal. Preferably, the notch is formed by punching downwardly through the upper face of the terminal. A tooth is then formed in each edge of the terminal edges forwardly of the notches, by deflecting a portion of the terminal downwardly to form a tooth having a lower leading edge formed of the forward edge of the notch.

DESCRIPTION OF THE PREFERRED EMBODIMENT

Figure 1:
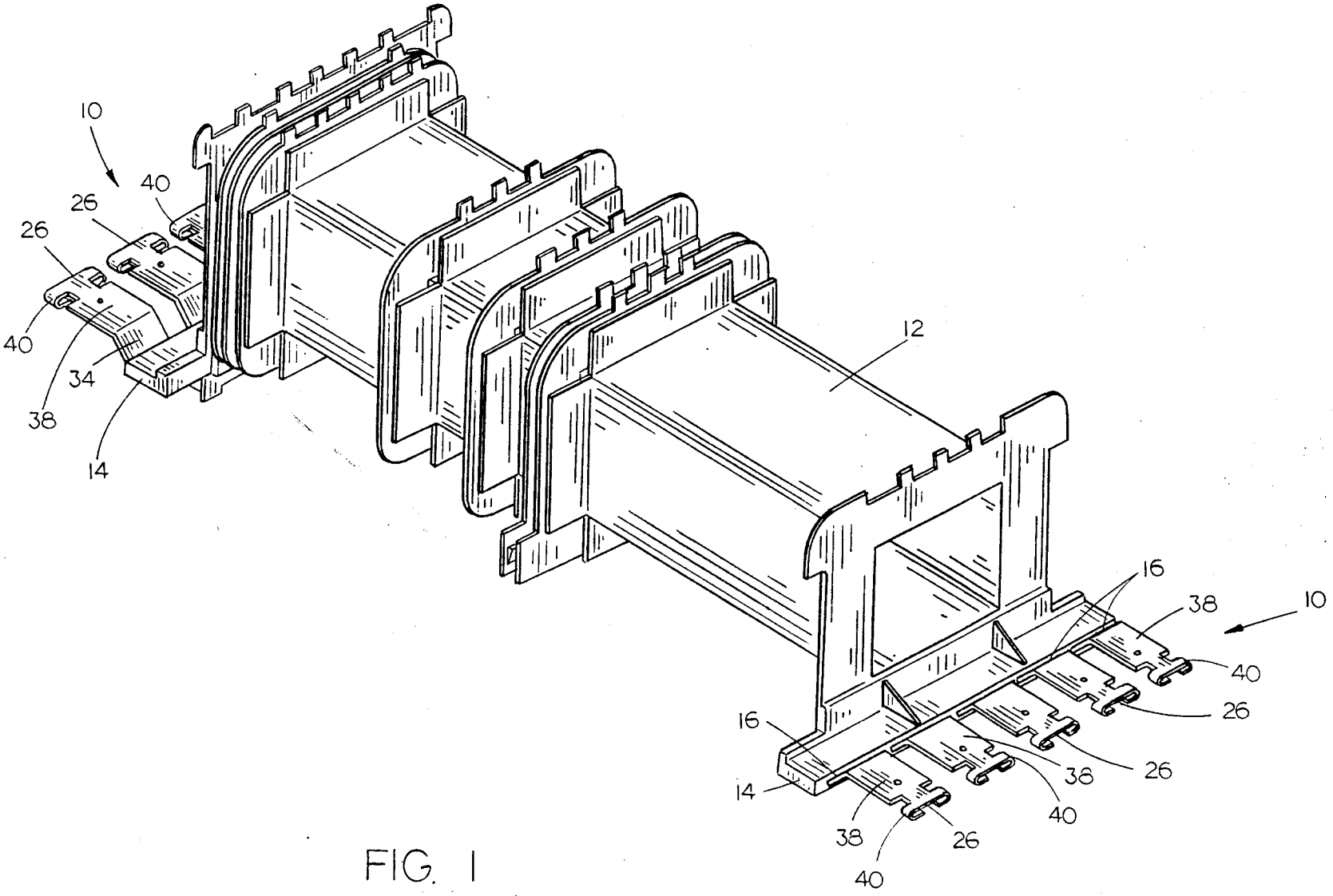
FIG. 1 is a perspective view of a bobbin utilized in a ballast of a fluorescent lamp fixture, having the terminals of the present invention installed on each end thereof.
Figure 2:
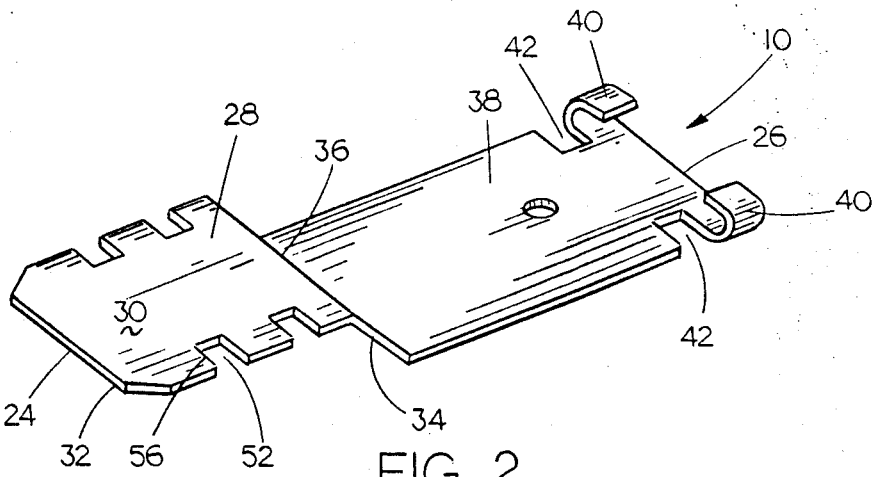
FIG. 2 is a perspective view of the underside of the terminal of the present invention after a first step of the method of creating the teeth has occurred.
Figure 3:
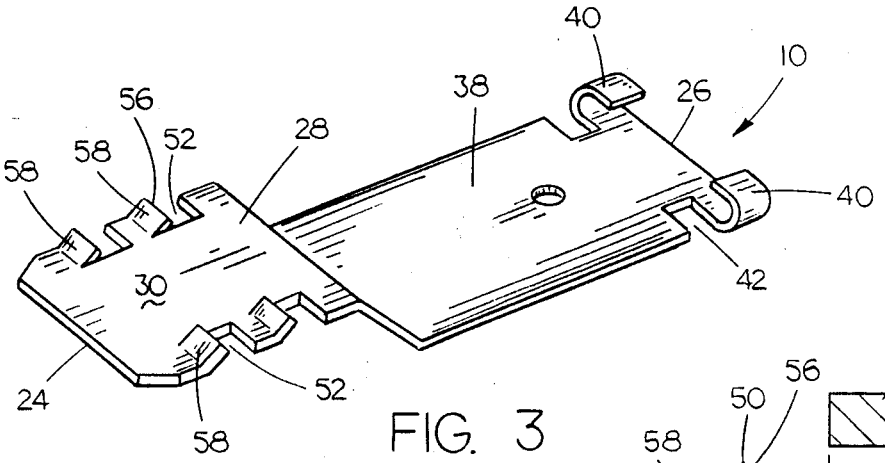
FIG. 3 is a perspective view of the underside of the terminal of the present invention upon completion of the final step for forming the teeth thereof.
Figure 5:
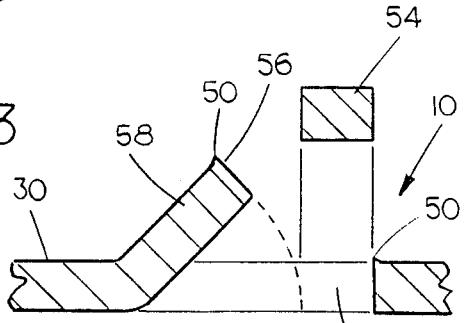
FIG. 5 is a sectional view through one tooth of the terminal, oriented as shown in FIG. 3.
Figure 4:
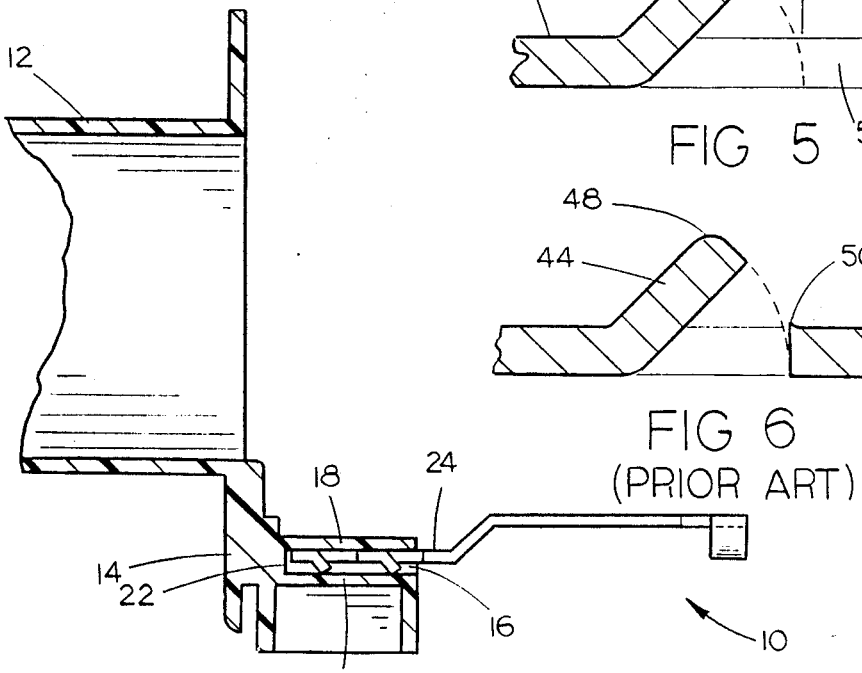
FIG. 4 is a sectional view through one end of a bobbin showing the terminal of the present invention installed thereon.

Referring now to the drawings, in which identical or corresponding parts are identified with the same reference numeral throughout the drawings, and more particularly to FIG. 1, the electrical terminal of the present invention is identified generally at 10 and is installed at one or both ends of a bobbin 12 of a thermoplastic material. As shown in FIGS. 1 and 4, bobbin 12 had a foot portion 14 at each end, with a plurality of horizontally spaced pockets 16 formed therein. Pockets 16 include an upper wall 18, lower wall 20 and rearward wall 22, and will receive one end of a terminal 10 therein.

For purposes of this description, terminal 10 will be described as having a forward end 24 and a rearward end 26, and a forwardly direction indicates the direction the terminal is moved to insert the forward end 24 into a pocket 16. Each terminal 10 is comprised of a resilient, electrically conductive material, and includes a forward portion 28 which is generally planar, an upper surface 32 and a lower surface 30. FIGS. 2, 3, 5 and 6 have terminals 10 oriented upside-down to more clearly view the teeth protruding therefrom. An angular portion 34 extends rearwardly from the rearward end 36 of forward portion 28, and is canted at an angle as shown in the drawings. A rearward portion 38 of terminal 10 extends rearwardly from angular portion 34 and is oriented generally parallel to forward portion 28. A pair of tabs 40 extend transversely from rearward end 26 of terminal 10, and have a pair of notches 42 cut adjacent thereto. Tabs 40 are bent into a general "U-shape" such that they may be crimped on a wire to form an electrical connection.

Figure 6:
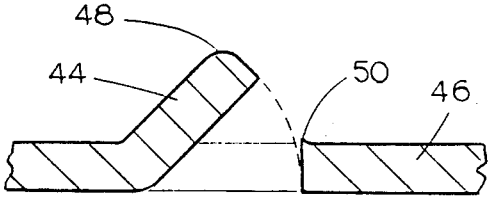
FIG 6 (PRIOR ART)
FIG. 6 is a sectional view through a tooth of a terminal of the prior art.

Referring now to FIG. 6, a tooth 44 of the prior art is formed along one edge of a terminal 46, by directly punching a generally rectangular portion into the terminal 46. Because the punch deflects the terminal as it is punched from the material, the lower "leading" edge 48 is formed with a slightly arcuate form. This is apparently caused during the punching process, with material from the leading edge being left upon the terminal 46 thereby creating a sharp burr 50 thereon.

The inventor herein has found that by punching a notch in the terminal prior to deflecting a tooth downwardly, the leading edge of the tooth will retain a sharp gripping edge and will have the burr 50′ created thereon. The method of this invention is shown more specifically in FIGS. 2, 3 and 5, described in more detail hereinbelow.

The first step of the method of the invention is to punch a notch 52 along one of the longitudinal edges of forward portion 28 of terminal 10. More specifically, it is preferred that the notch be punched in the same direction as that of the punch used to form the tooth, so as to leave a sharp edge (burr 50′) at the lower face 30 of the terminal. This is shown more specifically in FIG. 5, wherein the portion of the terminal removed is identified generally at 54, and has been removed by punching downwardly on the upper face 32 of terminal 10. As mentioned previously, this Figure is inverted for clear association with FIGS. 2, 3 and 6; hence a "downward" direction is shown "upward" in this Figure. The forward edge 56 of notch 52 will form the "leading" edge of a gripping tooth 58.

Tooth 58 is formed by deflecting a tab downwardly, using a punch or the like, from below. Leading edge 56 of tooth 58 is not separated from adjacent material during the deflecting step of the operation, and will therefore retain, the sharp edge formed by the downward punch of the previous step which creates the sharp burr 50′ on tooth 58.

Because leading edge 56 of tooth 58 is sharp, the angle at which the tooth 58 must be deflected need only be slightly greater than the width of the pocket, such that the leading edge 56 will be slightly biased against lower wall 20 of pocket 16. Any attempt to move the terminal rearwardly will cause the leading edge 56 (burr 50′) to immediately dig into the plastic material of wall 20 and prevent the rearward movement. Because the angle of the tooth is only as great as required to cause the leading edge to be biased against the lower wall 20 of pocket 16, the force required to insert the terminal is minimal, and no distortion of the lower wall 20 would occur.

Whereas the invention has been shown and described in connection with the preferred embodiment thereof, it will be understood that many modifications, substitutions and additions may be made which are within the broad scope of the appended claims. For example, a tooth 58 may be formed in the center of the terminal rather than an edge, or a plurality of teeth may be formed in each longitudinal edge.

Thus, there has been shown and described an improved terminal for a bobbin which accomplishes at least all of the above-stated objects.

I claim:

1. A terminal for insertion into a bobbin pocket, comprising:

a substantially flat, resilient electrically conductive terminal member having a forward end for insertion forwardly into the bobbin pocket, a rearward end, an upper face and a lower face, a forward portion which will be received within the bobbin pocket, and a rearward portion which will project rearwardly out of the bobbin pocket;

said forward portion having a notch formed in each side edge thereof, each notch having a forward edge;

a tooth bent downwardly and rearwardly along each side edge forwardly of said notches with the forward edge of the notch forming the lower leading edge of the projecting tooth, said leading edge having a sharp burr protruding therefrom for gripping a wall of the pocket.

2. In combination:

a ballast bobbin having a plurality of pockets formed therein for supporting and retaining electrical terminals, said bobbin pockets including an upper wall, lower wall and rearward wall;

a substantially flat, resilient electrically conductive terminal member having a forward end and forward portion within said bobbin pocket, a rearward end, an upper face and a lower face, and a rearward portion projecting rearwardly out of the bobbin pocket;

said forward portion having a notch formed in each side edge thereof, each notch having a forward edge;

a tooth bent downwardly and rearwardly along each side edge forwardly of said notches with the forward edge of the notch forming the lower leading edge of the projecting tooth, said leading edge having a sharp burr protruding therefrom for gripping a wall of the pocket; and each said tooth being bent at an angle such that the lower leading edge of the tooth will be biased against the lower wall of the pocket, and such that the resilient characteristics of the terminal material will force the leading edge into the wall of the pocket upon movement of the terminal in a rearward direction.

* * * * *